US007431355B2

(12) United States Patent
Eenigenburg et al.

(10) Patent No.: US 7,431,355 B2
(45) Date of Patent: Oct. 7, 2008

(54) TILT-LATCH FOR A SASH WINDOW

(75) Inventors: Mark B. Eenigenburg, Lansing, IL (US); Dean Pettit, St. John, IN (US)

(73) Assignee: Newell Operating Company, Atlanta, GA (US)

( * ) Notice: Subject to any disclaimer, the term of this patent is extended or adjusted under 35 U.S.C. 154(b) by 0 days.

(21) Appl. No.: 11/473,529

(22) Filed: Jun. 23, 2006

(65) Prior Publication Data

US 2008/0012352 A1 Jan. 17, 2008

(51) Int. Cl.
*E05C 1/10* (2006.01)
*E05D 15/22* (2006.01)

(52) U.S. Cl. ..... 292/175; 292/163; 292/DIG. 47; 49/175

(58) Field of Classification Search ..... 292/175, 292/163, DIG. 20, 317, DIG. 47; 70/89, 70/90; 49/183–185, 180, 172, 449
See application file for complete search history.

(56) References Cited

U.S. PATENT DOCUMENTS

| | | | | |
|---|---|---|---|---|
| 0,016,228 | A | | 12/1856 | Copeland |
| 1,781,729 | A | | 11/1930 | Major |
| 2,568,273 | A | | 9/1951 | Clark |
| 2,965,935 | A | | 12/1960 | Olsen |
| 3,080,621 | A | | 3/1963 | Mendelsohn |
| 3,099,050 | A | | 7/1963 | Hetman |
| 3,122,797 | A | | 3/1964 | Segre |
| 3,469,875 | A | | 9/1969 | Ahlgren |
| 3,841,674 | A | | 10/1974 | Bisbing et al. |
| 3,850,464 | A | | 11/1974 | Bisbing et al. |
| 4,167,835 | A | | 9/1979 | Nobes et al. |
| 4,400,026 | A | | 8/1983 | Brown, Jr. |
| 4,475,311 | A | | 10/1984 | Gibson |
| 4,482,178 | A | | 11/1984 | Damiana |
| 4,553,353 | A | * | 11/1985 | Simpson ..... 49/161 |
| 4,578,903 | A | * | 4/1986 | Simpson ..... 49/175 |
| 4,581,850 | A | | 4/1986 | Simpson |
| 4,622,778 | A | * | 11/1986 | Simpson ..... 49/161 |
| 4,669,765 | A | | 6/1987 | Ullman |
| 4,790,579 | A | | 12/1988 | Maxwell et al. |
| 4,791,756 | A | * | 12/1988 | Simpson ..... 49/175 |
| 4,824,154 | A | | 4/1989 | Simpson |
| 4,837,975 | A | * | 6/1989 | Simpson ..... 49/175 |
| 4,901,475 | A | * | 2/1990 | Simpson ..... 49/175 |
| 4,917,413 | A | | 4/1990 | Jason et al. |
| 5,028,083 | A | | 7/1991 | Mischenko |
| 5,068,932 | A | | 12/1991 | Chang |
| 5,096,240 | A | | 3/1992 | Schultz |
| 5,121,951 | A | | 6/1992 | Harbom et al. |

(Continued)

*Primary Examiner*—Patricia Engle
*Assistant Examiner*—Alyson M Merlino
(74) *Attorney, Agent, or Firm*—Banner & Witcoff, Ltd.

(57) ABSTRACT

A latch mechanism for a sash window assembly includes a housing having a top surface with an opening therein and a latch bolt moveable between an extended position and a retracted position. The latch bolt is slidably supported by two clips depending from the housing. A biasing spring biases the bolt toward the extended position. A retaining member is also attached to the housing. A portion of the retaining member extends into the bolt to retain the bolt to the housing. An actuator connected to the bolt is accessible through the opening in the housing. The actuator can be manipulated by a user to move the bolt between the extended position and the retracted position.

25 Claims, 5 Drawing Sheets

U.S. PATENT DOCUMENTS 5,121,952 A 6/1992 Jason
5,127,685 A 7/1992 Dallaire et al.
5,139,291 A 8/1992 Schultz
5,145,221 A * 9/1992 Pennebaker et al. ..... 292/175
5,165,737 A * 11/1992 Riegelman ..... 292/42
5,301,989 A 4/1994 Dallmann et al.
5,536,052 A 7/1996 Maier
5,618,067 A 4/1997 Carlson et al.
5,669,180 A 9/1997 Maier
5,669,639 A 9/1997 Lawrence
5,671,958 A 9/1997 Szapucki et al.
5,806,900 A 9/1998 Bratcher et al.
5,829,196 A 11/1998 Maier
5,927,013 A 7/1999 Slocomb et al.
5,970,656 A 10/1999 Maier
5,996,283 A 12/1999 Maier
6,021,603 A 2/2000 Prete et al.
6,155,615 A 12/2000 Schultz
6,178,696 B1 1/2001 Liang
6,183,024 B1 2/2001 Schultz et al.
6,485,070 B1 11/2002 Schultz

* cited by examiner

TILT-LATCH FOR A SASH WINDOW

TECHNICAL FIELD

The invention relates to window hardware for a window slidable within a master frame, and more specifically, to a tilt-latch mechanism for a sash window.

BACKGROUND OF THE INVENTION

A pivotal sash window adapted for installation in a master frame of a sash window assembly is well known. The sash window is slidable within the master frame. Typically, tilt-latches are installed on or in the sash window and, along with other cooperating hardware, allow the sash window to be pivoted from the frame. The tilt-latches typically have a latch bolt slidably supported by a housing. Certain tilt-latch designs provide suitable structures for supporting the latch bolt in the housing. While tilt-latches according to the prior art provide a number of advantageous features, they nevertheless have certain limitations.

The present invention is provided to solve the problems discussed above and other problems, and to provide advantages and aspects not provided by prior tilt-latches of this type. A full discussion of the features and advantages of the present invention is deferred to the following detailed description, which proceeds with reference to the accompanying drawings.

SUMMARY OF THE INVENTION

The present invention provides a latch mechanism for a sash window assembly. The sash window assembly has a sash window slidable within a master frame. The latch mechanism adapted for releasably securing the sash window to the master frame and generally includes a housing, two clips depending from the housing, a moveable latch bolt, and a retaining member attached to the housing.

The housing is adapted to be supported by the sash window and includes a top plate having an opening therein, a first side wall and a second side wall depending from an outer portion of the top plate, and a post depending from an inner portion of the top plate. The post is adapted to receive a fastener therethrough. The bolt is moveable between an extended position and a retracted position. In the extended position, the bolt is adapted to engage the master frame, and in the retracted position, the bolt is adapted to be retracted from the master frame. The bolt has a channel and a pair of linear tracks. The bolt also has a slot receiving the post therein. The clips depend from the housing, and each clip has an inwardly-extending lip thereon. The bolt is slidably supported by the clips, such that each of the lips slides along one of the tracks. The latch mechanism includes a biasing means for biasing the bolt toward the extended position. The biasing means is positioned in the channel within the bolt. The retaining member is attached to the housing and includes a projection and an abutment surface. The abutment surface abuts the biasing means. The projection extends into the channel and engages an underside surface of the bolt to retain the bolt to the housing when the bolt is in the extended position. The latch mechanism also includes an actuator connected to the bolt and accessible through the opening in the housing. The actuator is adapted to be manipulated by a user to move the bolt between the extended position and the retracted position.

According to another aspect of the invention, the bolt is moveable in a sliding direction and the projection extends into the channel in a direction substantially parallel to the sliding direction.

According to another aspect of the invention, the projection extends below an underside surface of the bolt and in a direction substantially parallel to the underside surface of the bolt.

According to another aspect of the invention, the opening defines a recessed portion in the housing, and the retaining member depends from the recessed portion.

The present invention also provides a latch mechanism for a sash window assembly as described above. The latch mechanism includes a housing adapted to be supported by the sash window, a moveable latch bolt slidably supported by the housing, a means for biasing the bolt toward the extended position, a support assembly, and a retaining assembly. The housing has a top surface having an opening therein. The bolt is moveable between an extended position, where the bolt is adapted to engage the master frame, and a retracted position, where the bolt is adapted to be retracted from the master frame. The bolt further has a channel. The support assembly includes a first clip and a second clip attached to one of the housing and the bolt and a first linear track and a second linear track on the other of the housing and the bolt. The bolt is slidably supported by the support assembly wherein a portion of the first clip slides along the first track and a portion of the second clip slides along the second track. The retaining assembly includes a retaining member attached to one of the housing and the bolt. A portion of the retaining member engages the other of the housing and the bolt to retain the bolt to the housing. The latch mechanism also includes an actuator connected to the bolt and accessible through the opening in the housing. The actuator is adapted to be manipulated by a user to move the bolt between the extended position and the retracted position.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
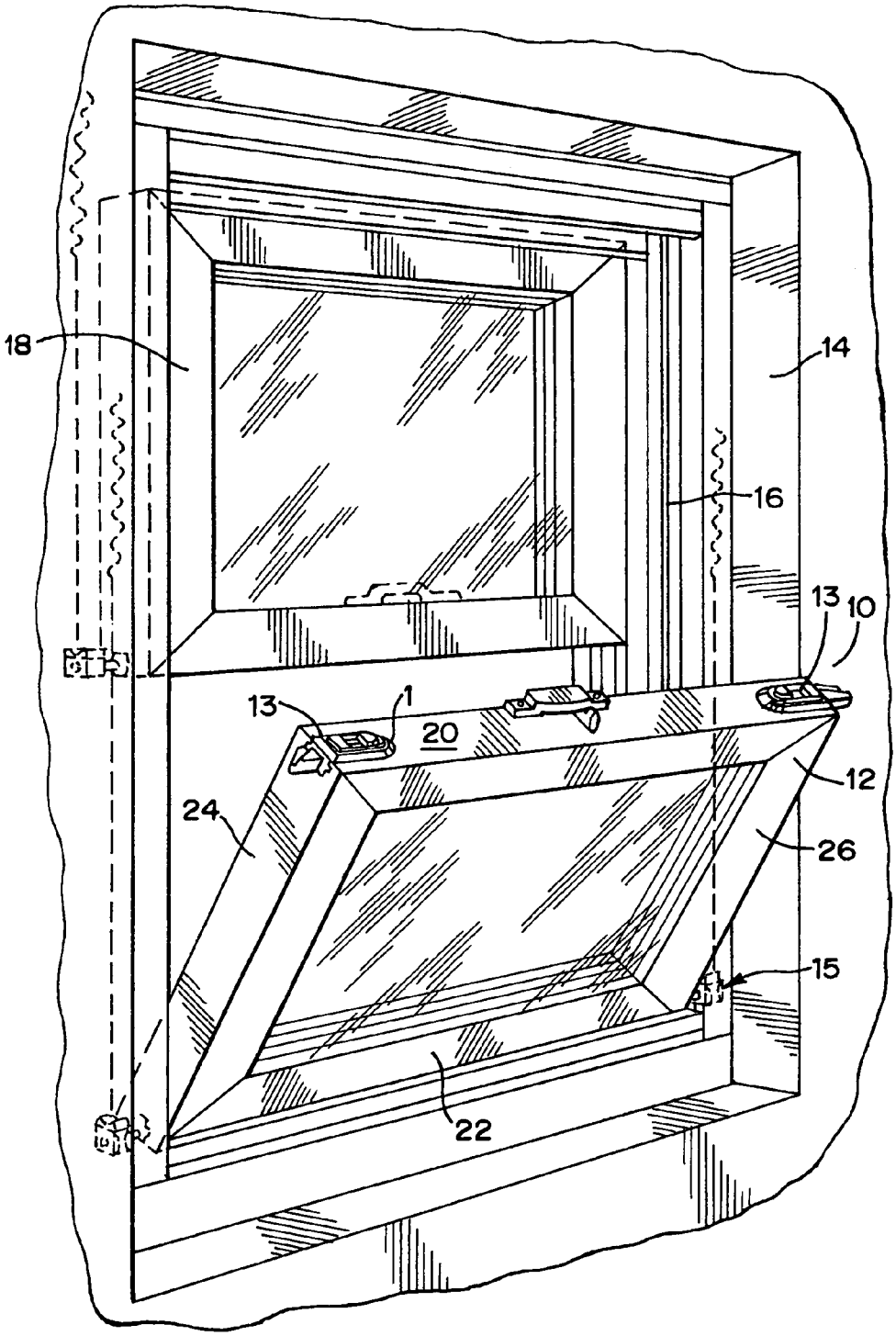
FIG. 1 is a schematic view of a sash window assembly.
Figure 2:
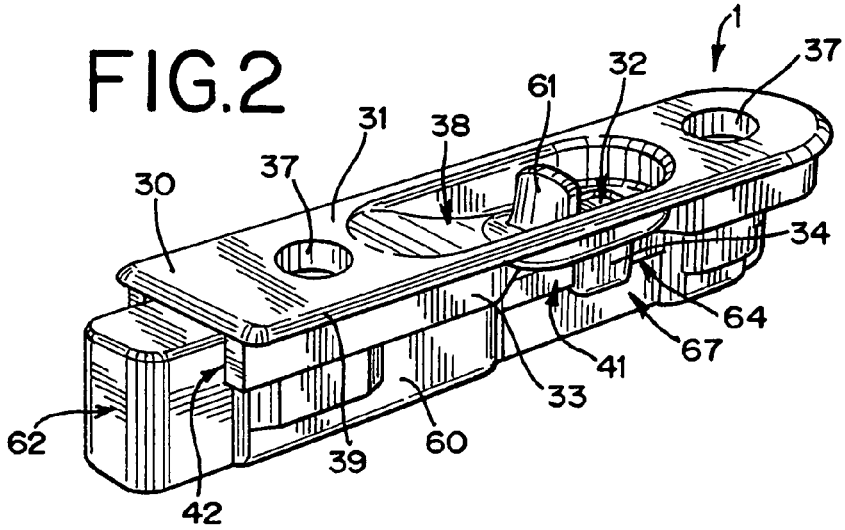
FIG. 2 is a perspective view of a tilt-latch of the present invention, shown in an extended position.
Figure 3:
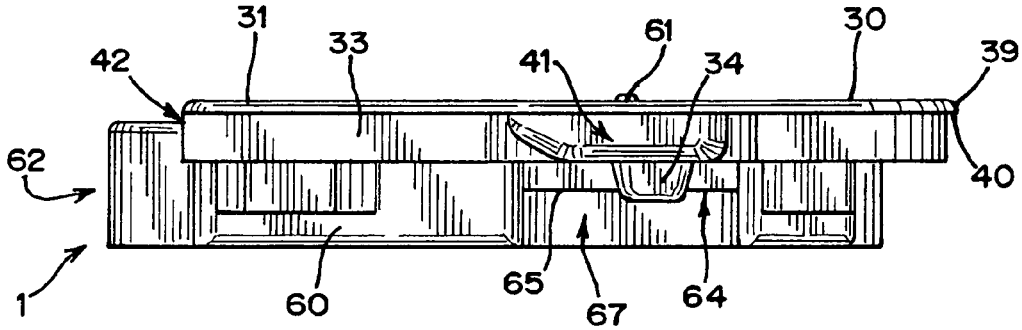
FIG. 3 is a side view of the tilt-latch of FIG. 2, shown in the extended position.
Figure 4:
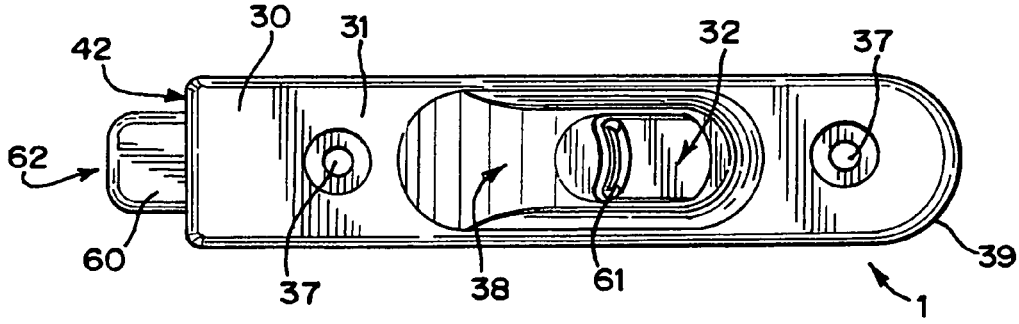
FIG. 4 is a top view of the tilt-latch of FIG. 2, shown in the extended position.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

A sash window assembly 10 is shown in FIG. 1. The particular sash window assembly 10 in FIG. 1 is a double-hung window assembly having a first or lower sash window 12 and a second or upper sash window 18 installed in a master frame 14. The lower sash window 12 is pivotally mounted to the master frame 14 by a sash balance/brake shoe assembly 15. The master frame 14 has opposed, vertically extending guide rails 16. The lower sash window 12 has a top sash member 20, a bottom sash member 22, and a pair of stiles 24,26, cooperatively connected together at adjacent extremities thereof to form a sash frame, typically rectangular although other shapes are possible. The upper sash window 18 is similarly constructed. The sash windows and master frame could be made from extrusions or pulltrusions that are filled with fiberglass, epoxy, plastic, or wood chips. These structures could also be solid and made from wood, masonite, pressboard, composite materials, or other materials as well, including aluminum. The preferred embodiment of the latch mechanism 1 is particularly suitable for use with sash windows made of wood.

Two tilt-latch mechanisms 1 are each mounted in slots 13 at each end of the top sash rail 20. The tilt-latch mechanisms 1 are schematically shown in FIG. 1. The preferred tilt-latch of the present invention is illustrated in FIGS. 2-10, and is adapted for releasably securing the sash window 12 to the master frame 14. The tilt-latch 1 generally includes a housing 30, a latch bolt 60, and a biasing spring 50. These components are described in greater detail below.

The preferred embodiment of the housing 30 is illustrated in FIGS. 2-10. As shown in FIGS. 1 and 8-10, the housing 30 is adapted to be supported by the top sash member 20, and is preferably installed within a cavity 13 in the top sash member 20. The housing is preferably elongated and generally includes a top plate 31 having an opening 32 therein and two side walls 33 depending from an outer portion of the top plate 31. Two clips 34, two posts 35, and a retaining member 36 are preferably affixed to the housing 30.

Figure 7:
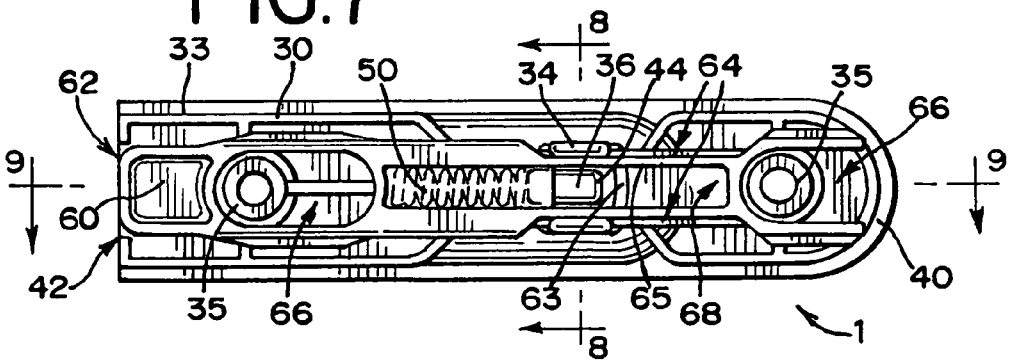
FIG. 7 is a bottom view of the tilt-latch of FIG. 2, shown in a retracted position.
Figure 8:
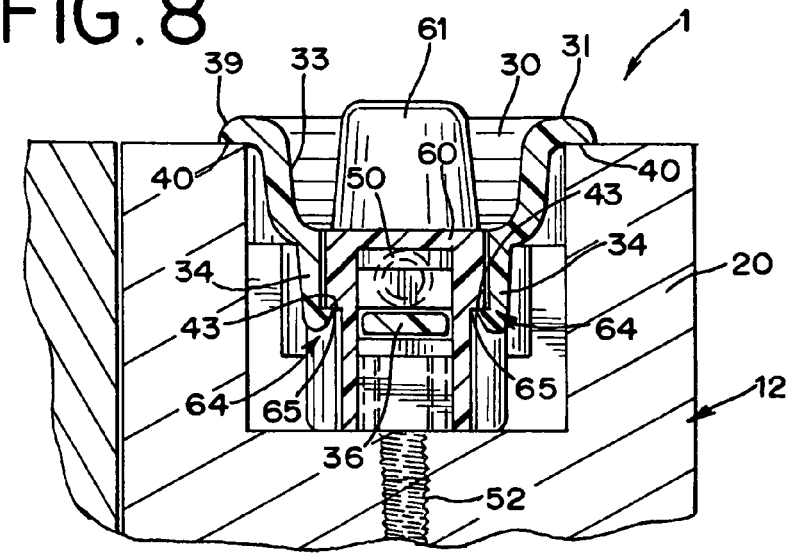
FIG. 8 is a cross-sectional view of the tilt-latch of FIG. 7 mounted in a sash window, taken along lines 8-8 of FIG. 7.
Figure 9:
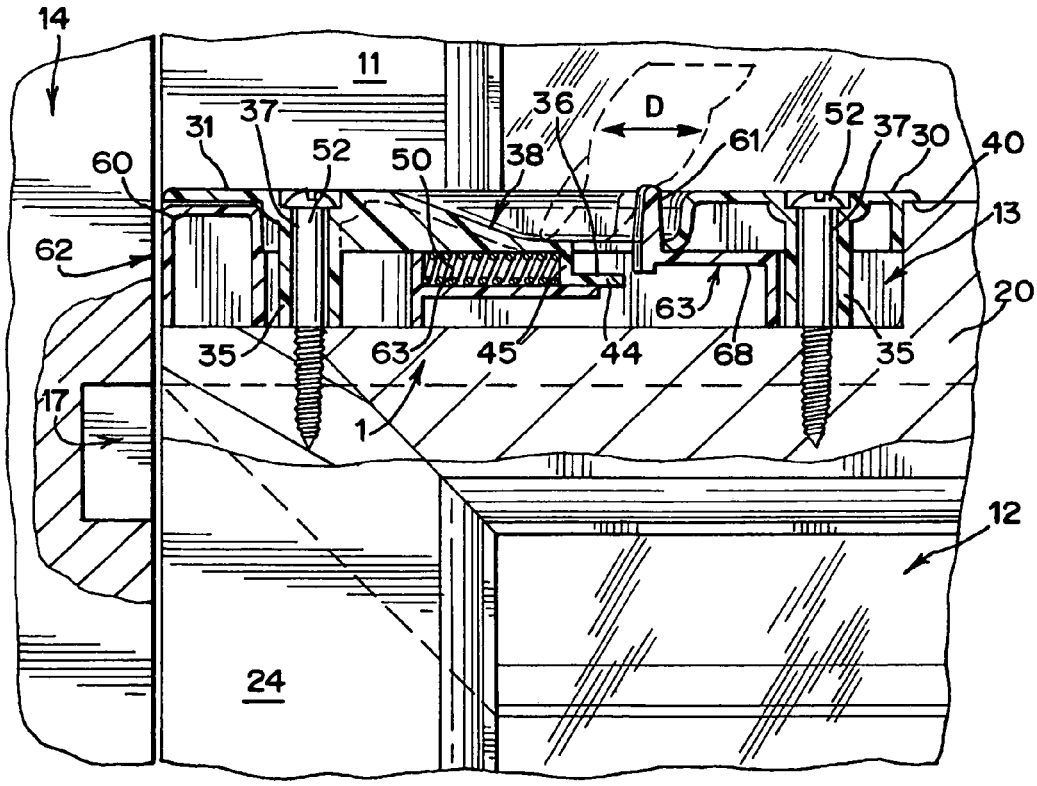
FIG. 9 is a cross-sectional view of the tilt-latch of FIG. 7 mounted in a sash window, shown in the retracted position, taken along lines 9-9 of FIG. 7.

As further illustrated in FIGS. 2-10, the top plate 31 has two fastener holes 37 and the opening 32 allows access to an actuator 61 operably connected to the latch bolt 60, as shown in FIG. 9. The top plate 31 also preferably has a recessed portion 38 proximate the opening 32 to facilitate access to, and operation of, the actuator 61. Additionally, the opening 32 is slightly elongated to permit movement of the actuator 61 within the opening 32. The top plate 31 is preferably elongated and rectangular in shape, with one rounded end, although other shapes are possible. Preferably, the side walls 33 depend from an outer portion of the top plate 31, but are located inward of the outer edge 39 of the top plate 31. This arrangement creates a ledge 40 on the underside of the top plate 31 that sits on the top surface of the top sash member 20 when the tilt-latch 1 is inserted into the cavity 13 in the sash window 12. The side walls 33 generally follow the shape of the top plate 31, but have a narrowed portion 41 proximate the opening 32 in the top plate 31, creating an hourglass-like shape. Preferably, the side walls 33 are connected by a rounded portion at one end and are not connected at the other end, creating an open end 42 of the housing 30 through which the latch bolt 60 extends.

As best illustrated in FIG. 8, two clips 34 are affixed to the housing 30, preferably depending from the narrowed portion 41 of the side walls 33. Alternately, the clips 34 may be located elsewhere on the housing 30, and the housing 30 may have a different number of clips. Each clip 34 preferably contains an inwardly-extending lip 43 for gripping the latch bolt 60. The two inwardly-extending lips 43 extend toward each other, as illustrated in FIG. 8. In other embodiments, the clip 34 has a different arrangement, for example, the lip 43 may extend outwardly. It is also envisioned that the two clips 34 may not be separate from each other, but may constitute a single piece, for example, a single depending member having two clips 34 thereon. In a preferred embodiment, the clips 34 are integral with the housing 30, but may alternately be separate pieces attached to the housing 30.

Figure 10:
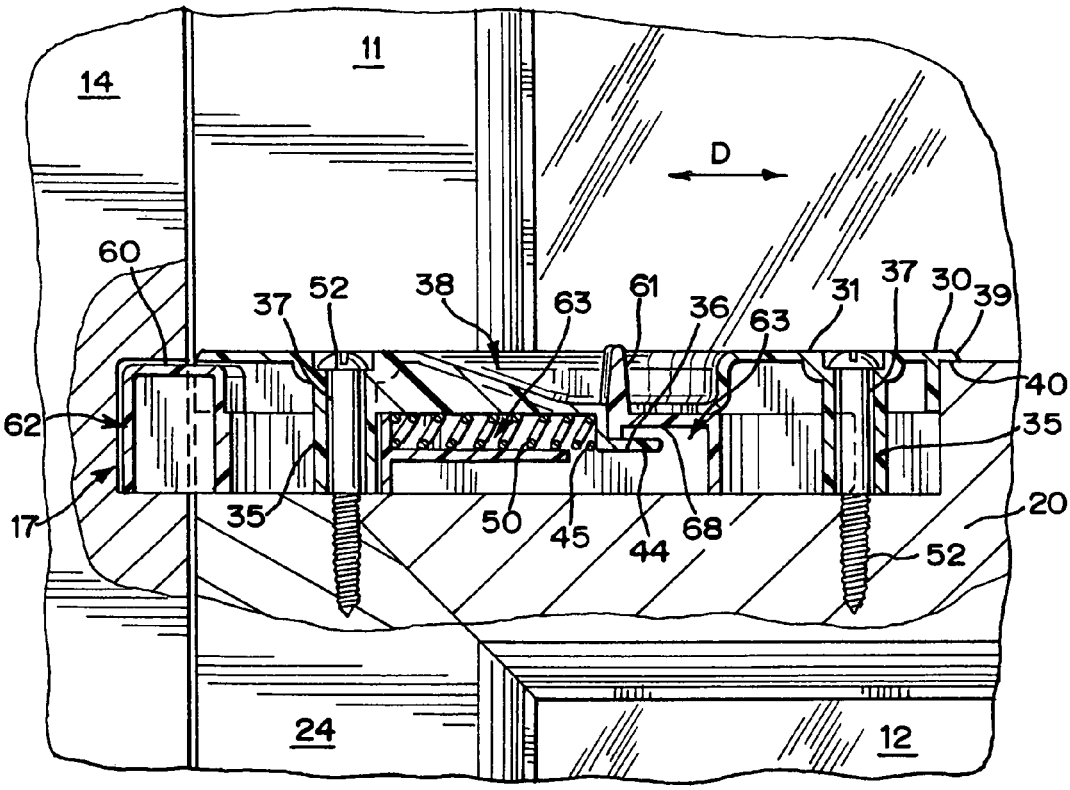
FIG. 10 is a cross-sectional view of the tilt-latch of FIG. 6 mounted in a sash window, shown in the extended position, taken along lines 10-10 of FIG. 6.

As best illustrated in FIGS. 9-10, a retaining member 36 is affixed to the housing 30, preferably depending from the inner portion of the housing 30. The retaining member 36 is configured for retaining the latch bolt 60 to the housing 30 and preferably contains a projection 44 and defines an abutment surface 45. The projection 44 extends into the latch bolt 60 to retain the latch bolt 60 to the housing 30, as described below. Preferably, the projection 44 is elongated and substantially rectangular in shape, and extends substantially lengthwise relative to the housing 30. The abutment surface 45 is preferably a flat surface that abuts the biasing means 50 when the latch bolt is assembled. Alternately, the retaining member 36 may be located elsewhere on the housing 30, or may be configured differently, and the housing 30 may have more than one retaining member 36.

Two posts are also attached to, or defined in, the housing, preferably depending from the inner portion of the top plate 31. The posts 35 are best illustrated in FIGS. 6-7 and 9-10. As shown in FIGS. 9-10, each post 35 is preferably cylindrical and hollow and constitutes an extension of one of the two fastener holes 37 in the top plate 31. Thus, the posts 35 of the preferred embodiment are each adapted to receive a fastener therethrough, preferably a screw or a nail, to affix the latch mechanism 1 to the sash window 12. Alternately, the number and locations of the posts 35 can vary, and the posts 35 may be differently shaped or configured to receive a different type of fastener.

The preferred embodiment of the latch bolt 60 is illustrated in FIGS. 2-10. The latch bolt 60 is slidably supported by the housing 30 and is moveable between an extended position (FIGS. 6 and 10), where the nose 62 of the latch bolt 60 is adapted to engage the master frame 12, and a retracted position (FIGS. 7 and 9), where the nose 62 of the latch bolt 60 is adapted to be retracted from the master frame 14.

The latch bolt 60 preferably has a channel 63 on the interior that holds the biasing means 50 and receives the retaining member 36 to retain the latch bolt 60 to the housing 30, as described below. As shown in FIGS. 5-10, the preferred channel 63 is elongated and rectangular in shape, and allows sufficient space for the action of the biasing means 50 and the movement of the retaining member 36 within the channel 63. A portion of the channel 63 is open toward the top of the latch bolt 60, and another portion is open toward the bottom of the latch bolt 60. In other embodiments, the size and configuration of the channel 63 can vary.

Figure 5:
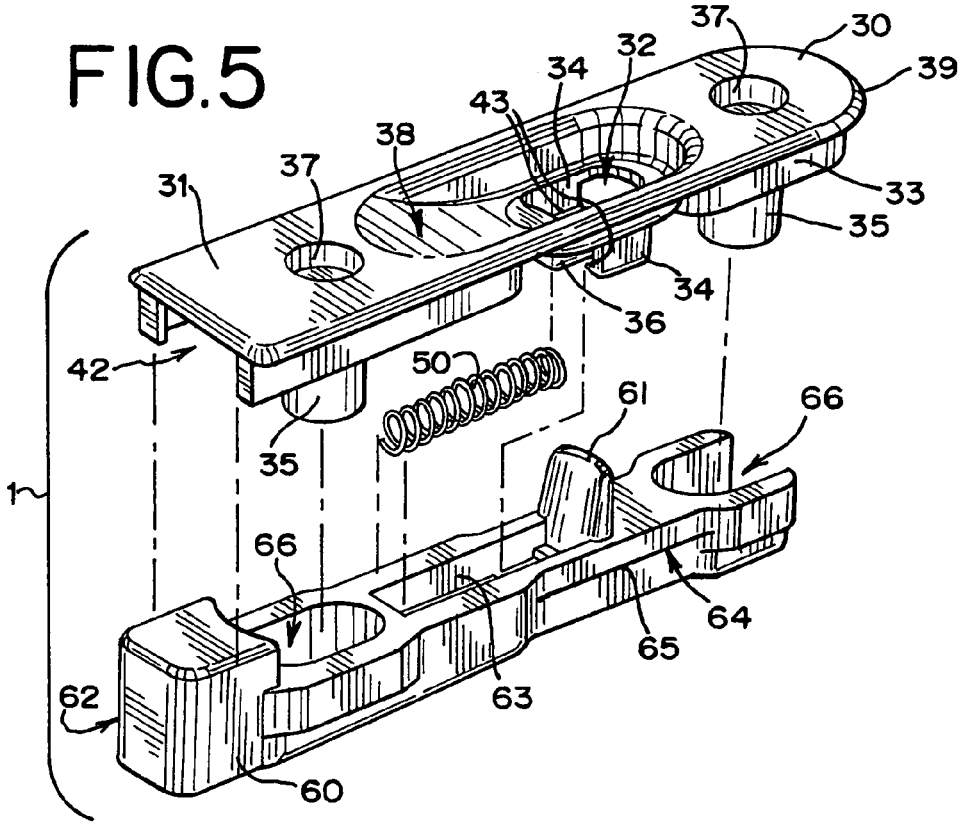
FIG. 5 is an exploded perspective view of the tilt-latch of FIG. 2.
Figure 6:
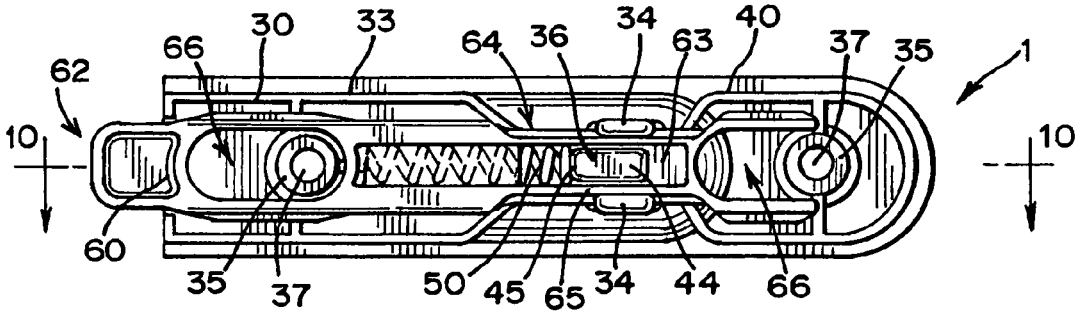
FIG. 6 is a bottom view of the tilt-latch of FIG. 2, shown in the extended position.

The latch bolt 60 also preferably has two linear tracks 64 extending along a portion of the length of the latch bolt 60. The clips 34 of the housing 30 grip the tracks 64 to slidably support the latch bolt 60. Preferably, the tracks 64 are formed by ledges 65 on the sides of the latch bolt 60, as illustrated in FIG. 8, providing surfaces for the clips 34 to grip. As shown in FIGS. 5-7, the tracks 64 are preferably positioned on a narrowed portion 67 of the latch bolt 60, preventing the bolt 60 from sliding farther than the end of the track 64.

Two slots 66 are preferably located at opposing ends of the latch bolt 60. Each of the slots 66 is configured to receive one of the two posts 35 therein when the latch bolt 60 is assembled. The slots 66 are long enough so that the latch bolt 60 can slide back and forth without obstruction by the posts 35 extending down through the slots 66. The size, shape, position, and necessity of the slots 66 can be adjusted to accommodate for changes in the design of the housing 30, including changes in the size, shape, or position of the posts 35.

Further, an actuator 61 is preferably located on the top of the latch bolt 60 and is accessible through the opening 32 in the housing, allowing a user to manipulate the latch bolt 60 between the extended and retracted positions. Generally, the actuator 61 is a tab projecting from the top of the latch bolt 60, but other designs may be used, including those known in the art, such as a finger groove. When the preferred latch mechanism 1 is assembled, the actuator 61 projects through the opening 32 in the housing 30, facilitating access to the actuator 61 by the user. In a preferred embodiment, the actuator 61 is integral with the latch bolt 60, but may alternately be a separate piece attached to the latch bolt 60.

In alternate embodiments, the latch bolt 60 may be configured differently, particularly if the housing 30 is differently configured. For example, the tracks 64 might be located elsewhere on the latch bolt 60, and may be designed to accommodate a greater number or different design of the clips 34. Also, as known in the art, the nose 62 may be beveled to facilitate closing of the window 12 when the latch bolt 60 is extended, as illustrated in FIG. 1.

Generally, the latch mechanism 1 preferably includes a means for biasing the latch bolt 60 toward the extended position. In the preferred embodiment, this biasing means is embodied by a biasing spring 50. The structure and positioning of this biasing spring 50 is illustrated in FIGS. 5-10. Other biasing means may be utilized with the present invention, including other types of springs (such as coil springs), as well as an elastic member or an integral resilient member on the housing 30 or the latch bolt 60.

Assembly of the latch mechanism 1 is illustrated in FIG. 5, and the assembled latch mechanism is shown in FIGS. 2-4 and 6-10. During assembly, the spring 50 is placed in the channel 63 of the latch bolt 60, and the housing 30 is forced downward over the latch bolt 60 to snap the mechanism 1 together. As the mechanism 1 is forced together, the posts 35 are received by the slots 66 in the latch bolt 60, the retaining member 36 enters the channel 63 of the latch bolt 60, and the clips 34 grip the tracks 64 to slidably support the latch bolt 60.

Once assembled, the latch mechanism 1 is securely retained together by a support assembly that includes the clips 34 and the tracks 64. The clips 34 slidably support the latch bolt 60. Generally, the clips 34 grip the tracks 64 to accomplish this function. In the preferred embodiment, best illustrated in FIG. 8, the clips 34 grip the tracks 64 so that the lips 43 of the clips 34 ride along the ledges 65 of the tracks 64. As described above, many alternate clip configurations are included within the scope of the present invention.

A retaining assembly, which includes the retaining member 36, also retains the latch bolt 60 to the housing 30. Generally, a portion of the retaining member 36 extends into the latch bolt 60 to retain the latch bolt 60 to the housing 30. As illustrated in FIGS. 9-10, the preferred embodiment of the retaining member includes the projection 44 and defines the abutment surface 45. The projection 44 extends into the channel 63 in the latch bolt 60 and below an underside surface 68 of the latch bolt 60, engaging the underside surface 68 of the latch bolt. Most preferably, the projection extends in a direction substantially parallel to the underside surface 68 of the latch bolt 60, as shown in FIGS. 9-10. The direction in which the projection 44 extends is also preferably substantially parallel to the sliding direction D (shown in FIGS. 7 and 9) of the latch bolt 60. The sliding direction D is defined as the direction in which the latch bolt 60 slides between the extended position and the retracted position. However, as described above, the retaining member 36 can be configured differently within the scope of the present invention.

As illustrated in FIGS. 9-10, the biasing spring 50 is preferably positioned in the channel 63 of the latch bolt 60 when the latch mechanism 1 is assembled. One end of the spring 50 abuts the abutment surface 45 of the retaining member 36 and the other end of the spring abuts the latch bolt 60 to exert force upon the latch bolt 60. In other embodiments, a different biasing means 50 may be used, as described above. Additionally, the biasing means 50 may be located or positioned differently within the latch mechanism 1.

In the assembled latch mechanism 1, the slots 66 allow the latch bolt 60 to move freely without being obstructed by the posts 35, as illustrated in FIGS. 6-7. As stated above, the posts 35 extend through the slots 66 and the slots 66 are dimensioned to allow the latch bolt 60 the proper freedom of movement.

The latch mechanism 1 is adapted to be mounted on the sash window 12. Preferably, the housing 30 is adapted to be supported by the sash window 12, and the housing 30, in turn, slidably supports the latch bolt 60. As shown in FIGS. 8-10, the latch mechanism 1 is preferably installed within a cavity 13 in the sash window 12. The assembled latch mechanism 1 is placed in the cavity 13 in the top sash member 20 of the sash window 12. Screws 52 or other fasteners are then inserted through the fastener holes 37 and the hollow posts 35, and are then screwed into the body of the sash window 12. These fasteners 52 secure the latch mechanism 1 tightly within the cavity 13. When the latch mechanism 1 is inserted into the cavity, the ledge 40 of the top plate 31 of the housing 30 sit upon the edges of the sash window 12 to stabilize the latch mechanism 1 and ensure proper positioning of the latch mechanism 1.

In alternate embodiments, the cooperative components of the support assembly and the retaining assembly may be switched between the latch bolt 60 and the housing 30. Generally, the present invention contemplates the use of a cooperative structure between the housing 30 and the latch bolt 60 to permit the housing 30 to slidably support the latch bolt 60. Thus, in one embodiment, the clips 34 are attached to one of the housing 30 and the latch bolt 60 and the tracks 64 are on the other of the housing 30 and the latch bolt 60 to slidably support the latch bolt 60. For example, the latch bolt 60 may have clips thereon that grip the housing 30, and the housing may have tracks for this purpose.

Similarly, the present invention contemplates generally the use of a retaining member and other cooperative structure between the housing 30 and the latch bolt 60 to retain the latch bolt 60 to the housing 30. Thus, in another embodiment, the retaining member is attached to one of the housing 30 and the latch bolt 60 and a portion of the retaining member extends into the other of the housing 30 and the latch bolt 60 to retain the latch bolt 60 to the housing 30. For example, the latch bolt 60 may have a retaining member thereon that extends into the housing 30 to retain the latch bolt 60 to the housing.

Operation of the latch mechanism 1 is best illustrated in FIGS. 6-7 and 9-10. The latch bolt 60 is moveable between the extended position, depicted in FIGS. 6 and 10, and the retracted position, depicted in FIGS. 7 and 9. Preferably, in the extended position, the nose 62 of the latch bolt 60 extends through the open end 42 of the housing 30 and is adapted to engage the master frame 14, and in the retracted position, the nose 62 of the latch bolt 60 is retracted completely within the housing 30 and is adapted to be disengaged from the master frame 14. When the sash window 12 is closed and the latch mechanism 1 is installed, the latch bolt 60 will be in the extended position, extended by the biasing spring 50 so the latch bolt 60 engages the master frame 14, illustrated in FIG. 10. In this arrangement, the nose 62 of the latch bolt 60 is received in the master frame 14, releasably securing the sash window 12 to the master frame 14. Although in FIGS. 9-10 the nose 62 is received in a recess 17 in the master frame 14, the nose 62 may also ride in one of the guide rails 16, allowing the window 12 to slide within the master frame 14 with the latch bolt 60 extended, as is known in the art and shown in FIG. 1.

To move the latch bolt 60 to the retracted position, a user (depicted by the phantomed finger in FIG. 9) manipulates the actuator 61 to pull the latch bolt 60 into the housing 30. The latch bolt 60 moves by sliding along the tracks 64 in the sliding direction D, illustrated in FIGS. 7 and 9. When the latch mechanism 1 is installed in the sash window 12, movement of the latch bolt 60 to the retracted position causes the latch bolt 60 to retract from the master frame 14 and disengage from the master frame 14, as shown in FIG. 9. This disengagement releases the sash window 12 from the master frame 14, allowing the window 12 to either slide within the frame 14 or tilt inward, depending on the configuration of the window assembly 10.

As shown in FIG. 10, when the latch bolt 60 is in the extended position, the retaining member 36 interlocks with the latch bolt 60 to retain the latch bolt 60 to the housing 30. To disassemble the latch mechanism 1, the latch bolt must be moved to the retracted position (FIG. 9), allowing the retaining member 36 to clear the housing 30. Since the extended position is the default position of the latch bolt 60 in the assembled latch mechanism 1 (due to the biasing means 50), disassembly of the latch mechanism 1 rarely occurs accidentally.

The present invention provides several benefits over prior tilt-latch mechanisms. The present two-piece design provides advantages in manufacturing and handling over prior three-piece designs. Additionally, prior tilt-latch designs could not be assembled prior to use, or would often disassemble during transport and/or handling if assembled prior to use. The two-piece latch mechanism 1 can be assembled prior to shipping, and will not separate during shipping like prior designs. Due to the retaining assembly and support assembly of the present invention, the disclosed tilt-latch mechanism rarely suffers from accidental disassembly, creating greater ease of handling.

While the specific embodiments have been illustrated and described, numerous modifications come to mind without significantly departing from the spirit of the invention, and the scope of protection is only limited by the scope of the accompanying Claims.

What is claimed is:

1. A latch mechanism for a sash window assembly, the sash window assembly having a sash window slidable within a master frame, the latch mechanism adapted for releasably securing the sash window to the master frame, the latch mechanism comprising:

a housing supported by the sash window, the housing having a top surface having an opening therein, the housing further comprises a retaining member comprising an abutment surface and a projection extending perpendicularly from an end of the abutment surface;

a bolt slidably supported by the housing and moveable between an extended position, wherein the bolt engages the master frame, and a retracted position, wherein the bolt is retracted from the master frame, the bolt having a channel;

means for biasing the bolt toward the extended position;

wherein the abutment surface abuts the biasing means, and the projection extends into the channel of the bolt and engages underneath a surface of the bolt to retain the bolt to the housing when the bolt is in the extended position; and an actuator connected to the bolt and accessible through the opening in the housing, the actuator being manipulated to move the bolt between the extended position and the retracted position.

2. The latch mechanism of claim 1, wherein the bolt is moveable in a sliding direction and the projection extends into the channel in a direction parallel to the sliding direction.

3. The latch mechanism of claim 1, wherein the projection extends in a direction parallel to an underside surface of the bolt.

4. The latch mechanism of claim 1, wherein the housing comprises a top plate, a first side wall and a second side wall depending from an outer portion of the top plate, and a post depending from an inner portion of the top plate, the opening located in the top plate.

5. The latch mechanism of claim 4, wherein the bolt further comprises a slot receiving the post therein.

6. The latch mechanism of claim 1, wherein the opening defines a recessed portion in the housing, and the retaining member depends from the recessed portion.

7. A latch mechanism for a sash window assembly, the sash window assembly having a sash window slidable within a master frame, the latch mechanism adapted for releasably securing the sash window to the master frame, the latch mechanism comprising:

a housing supported by the sash member, the housing comprising: a top surface having an opening therein, the housing further comprises a retaining member comprising an abutment surface and a projection extending perpendicularly from an end of the abutment surface;

a first clip and a second clip depending from the housing;

a bolt moveable between an extended position, wherein the bolt engages the master frame, and a retracted position, wherein the bolt is retracted from the master frame, the bolt having a first linear track defining a first ledge on a first sidewall and a second linear track defining a second ledge on a second sidewall, the bolt slidably supported by the first clip and the second clip wherein a portion of the first clip slides along the first track and a portion of the second clip slides along the second track;

means for biasing the bolt toward the extended position;

wherein the abutment surface abuts the biasing means, and the projection extends into the channel of the bolt and engages underneath a surface of the bolt to retain the bolt to the housing when the bolt is in the extended position; and an actuator connected to the bolt and accessible through the opening in the housing, the actuator being manipulated to move the bolt between the extended position and the retracted position.

8. The latch mechanism of claim 7, wherein the portion of the first clip that slides along the first track comprises a first inwardly-extending lip and the portion of the second clip that slides along the second track comprises a second inwardly-extending lip.

9. The latch mechanism of claim 8, wherein the first lip and the second lip extend toward each other.

10. The latch mechanism of claim 8, wherein the first lip engages an underside surface of the first track and the second lip engages an underside surface of the second track.

11. The latch mechanism of claim 7, wherein the first clip and the second clip extend below the opening.

12. The latch mechanism of claim 7, wherein the bolt has a narrowed portion and the tracks are located on the narrowed portion.

13. The latch mechanism of claim 7, wherein the housing comprises a top plate, a first side wall and a second side wall depending from an outer portion of the top plate, and a post depending from an inner portion of the top plate, the opening located in the top plate.

14. The latch mechanism of claim 13, wherein the bolt further comprises a slot receiving the post therein.

15. A latch mechanism for a sash window assembly, the sash window assembly having a sash window slidable within a master frame, the latch mechanism adapted for releasably securing the sash window to the master frame, the latch mechanism comprising:

a housing supported by the sash member, the housing having a top surface having an opening therein, the housing further comprises a retaining member comprising an abutment surface and a projection extending perpendicularly from an end of the abutment surface;

a first clip and a second clip depending from the housing;

a bolt moveable between an extended position, wherein the bolt engages the master frame, and a retracted position, wherein the bolt is retracted from the master frame, the bolt slidably supported by the first clip and the second clip;

a biasing means for biasing the bolt toward the extended position;

wherein the abutment surface abuts the biasing means, and the projection of the retaining member extends into the bolt and engages underneath a surface of the bolt to retain the bolt to the housing when the bolt is in the extended position; and an actuator connected to the bolt and accessible through the opening in the housing, the actuator being manipulated to move the bolt between the extended position and the retracted position.

16. The latch mechanism of claim 15, wherein the bolt moves between the extended position and the retracted position in a sliding direction, and the projection of the retaining member extends into a channel in the bolt in a direction parallel to the sliding direction to retain the bolt to the housing.

17. The latch mechanism of claim 16, wherein the biasing means is positioned in the channel in the bolt.

18. The latch mechanism of claim 15, wherein the bolt moves between the extended position and the retracted position in a sliding direction, and the projection extends in a direction parallel to the sliding direction.

19. The latch mechanism of claim 15, wherein the bolt has a first linear track and a second linear track, and the bolt is slidably supported by the first clip and the second clip wherein a portion of the first clip slides along the first track and a portion of the second clip slides along the second track.

20. The latch mechanism of claim 19, wherein the portion of the first clip that slides along the first track comprises a first inwardly-extending lip and the portion of the second clip that slides along the second track comprises a second inwardly-extending lip.

21. The latch mechanism of claim 15, wherein the housing comprises a top plate, a first side wall and a second side wall depending from an outer portion of the top plate, and a post depending from an inner portion of the top plate, the opening located in the top plate.

22. The latch mechanism of claim 21, wherein the bolt further comprises a slot receiving the post therein.

23. A latch mechanism for a sash window assembly, the sash window assembly having a sash window slidable within a master frame, the latch mechanism adapted for releasably securing the sash window to the master frame, the latch mechanism comprising:

a housing supported by the sash window, the housing comprising: a top plate having an opening therein, a first side wall and a second side wall depending from an outer portion of the top plate, and a post depending from an inner portion of the top plate, the housing further comprises a retaining member comprising an abutment surface and a projection extending perpendicularly from an end of the abutment surface;

a first clip and a second clip depending from the housing, the first clip having a first inwardly-extending lip thereon and the second clip having a second inwardly-extending lip thereon;

a bolt moveable between an extended position, wherein the bolt engages the master frame, and a retracted position, wherein the bolt is retracted from the master frame, the bolt having a channel and a first linear track and a second linear track, the bolt slidably supported by the first clip and the second clip wherein the first lip slides along the first track and the second lip slides along the second track, the bolt further having a slot receiving the post therein;

a biasing means for biasing the bolt toward the extended position, the biasing means positioned in the channel in the bolt;

wherein the abutment surface abuts the biasing means, and the projection extends into the channel of the bolt and engages underneath a surface of the bolt to retain the bolt to the housing when the bolt is in the extended position;

an actuator connected to the bolt and accessible through the opening in the housing, the actuator being manipulated to move the bolt between the extended position and the retracted position; and wherein the opening defines a recessed portion in the housing, and the retaining member depends from the recessed portion.

24. A latch mechanism for a sash window assembly, the sash window assembly having a sash window slidable within a master frame, the latch mechanism adapted for releasably securing the sash window to the master frame, the latch mechanism comprising:

a housing supported by the sash window, the housing having a top surface having an opening therein;

a bolt slidably supported by the housing and moveable between an extended position, wherein the bolt engages the master frame, and a retracted position, wherein the bolt is retracted from the master frame, the bolt having a channel;

means for biasing the bolt toward the extended position;

an actuator connected to the bolt and accessible through the opening in the housing, the actuator being manipulated to move the bolt between the extended position and the retracted position;

a support assembly comprising a first clip and a second clip attached to one of the housing and the bolt and a first linear track and a second linear track on the other of the housing and the bolt, the bolt slidably supported by the support assembly wherein a portion of the first clip slides along the first track and a portion of the second clip slides along the second track; and a retaining assembly comprising a retaining member formed integrally with one of the housing and the bolt, the retaining member comprising an abutment surface and a projection extending perpendicularly from an end of the abutment surface, the abutment surface abutting the biasing means, and the projection of the retaining member engaging underneath a surface of the other of the housing and the bolt to retain the bolt to the housing when the bolt is in the extended position.

25. A latch mechanism for a sash window assembly, the sash window assembly having a sash window slidable within a master frame, the latch mechanism adapted for releasably securing the sash window to the master frame, the latch mechanism comprising:

a housing supported by the sash member, the housing comprising a top surface having an opening therein, the housing defining a lower edge, the housing further comprises a retaining member comprising an abutment surface and a portion extending perpendicularly from an end of the abutment surface;

a first clip and a second clip depending from the housing;

a bolt moveable between an extended position, wherein the bolt engages the master frame, and a retracted position, wherein the bolt is retracted from the master frame, the bolt having a first linear track and a second linear track, the bolt slidably supported by the first clip and the second clip wherein a portion of the first clip slides along the first track and a portion of the second clip slides along the second track, such that the bolt extends past the lower edge of the housing;

means for biasing the bolt toward the extended position;

wherein the portion of the retaining member extends into a channel of the bolt, the portion engages underneath a surface of the bolt when the bolt is in an extended position to retain the bolt to the housing; and an actuator connected to the bolt and accessible through the opening in the housing, the actuator being manipulated to move the bolt between the extended position and the retracted position.

* * * * *